US009181750B2

(12) United States Patent
Ticoalu et al.

(10) Patent No.: US 9,181,750 B2
(45) Date of Patent: Nov. 10, 2015

(54) PULL CORD ON HEADRAIL FOR OPERATING A MOTORIZED BLIND

(75) Inventors: Johann Rouben Reinier Ticoalu, Leiden (NL); Jorg Bohlen, Langen (DE)

(73) Assignee: Hunter Douglas Industries B.V., Rotterdam (NL)

( * ) Notice: Subject to any disclaimer, the term of this patent is extended or adjusted under 35 U.S.C. 154(b) by 145 days.

(21) Appl. No.: 13/808,061

(22) PCT Filed: Jun. 24, 2011

(86) PCT No.: PCT/EP2011/003117

§ 371 (c)(1), (2), (4) Date: Feb. 6, 2013

(87) PCT Pub. No.: WO2012/000629

PCT Pub. Date: Jan. 5, 2012

(65) Prior Publication Data

US 2013/0146436 A1 Jun. 13, 2013

(30) Foreign Application Priority Data

Jul. 1, 2010 (EP) ..... 100068188

(51) Int. Cl.

| | |
|---|---|
| ***H01H 17/00*** | (2006.01) |
| ***E06B 9/24*** | (2006.01) |
| ***E06B 9/262*** | (2006.01) |
| ***E06B 9/78*** | (2006.01) |

(52) U.S. Cl.

CPC . *E06B 9/24* (2013.01); *E06B 9/262* (2013.01); *E06B 9/78* (2013.01); *H01H 17/00* (2013.01); *E06B 2009/2625* (2013.01)

(58) Field of Classification Search

USPC ..... 318/3; 200/502, 537, 543

See application file for complete search history.

(56) References Cited

U.S. PATENT DOCUMENTS

| | | | | |
|---|---|---|---|---|
| 5,252,794 | A * | 10/1993 | Tseng | 200/51.15 |
| 5,278,366 | A * | 1/1994 | Fleischhauer | 200/51.15 |
| 5,517,094 | A * | 5/1996 | Domel et al. | 318/400.08 |
| 5,793,174 | A * | 8/1998 | Kovach et al. | 318/468 |
| 5,990,646 | A * | 11/1999 | Kovach et al. | 318/468 |
| 6,057,658 | A * | 5/2000 | Kovach et al. | 318/16 |
| 6,181,089 | B1 * | 1/2001 | Kovach et al. | 318/16 |
| 6,259,218 | B1 * | 7/2001 | Kovach et al. | 318/16 |
| 6,369,530 | B2 * | 4/2002 | Kovach et al. | 318/16 |
| 7,399,940 | B1 * | 7/2008 | Tseng | 200/544 |
| 7,652,439 | B2 | 1/2010 | Tang | |
| 7,723,939 | B2 * | 5/2010 | Carmen, Jr. | 318/466 |
| 8,522,852 | B2 * | 9/2013 | Yu et al. | 160/84.05 |
| 2001/0050538 | A1 * | 12/2001 | Kovach et al. | 318/16 |
| 2002/0190678 | A1 * | 12/2002 | Huber et al. | 318/434 |
| 2011/0265958 | A1 * | 11/2011 | Skinner et al. | 160/127 |

FOREIGN PATENT DOCUMENTS

WO 2010/011751 A1 1/2010

* cited by examiner

*Primary Examiner* — Kawing Chan

(74) *Attorney, Agent, or Firm* — Dorsey & Whitney LLP

(57) ABSTRACT

A motorized blind having a pull cord. The pull cord is mechanically connected to an electrical switch in a headrail of the blind, the switch being electrically connected to an electric motor within the headrail. The pull cord also extends outwardly of an end of the headrail and then outwardly and downwardly of the blind through a hole in the front of an end cap on the headrail.

16 Claims, 5 Drawing Sheets

PULL CORD ON HEADRAIL FOR OPERATING A MOTORIZED BLIND

CROSS-REFERENCE TO RELATED APPLICATIONS

This application is the national stage application of PCT International Patent Application No. PCT/EP2011/003117 entitled "Pull Cord on Headrail For Operating a Motorized Blind" filed on Jun. 24, 2011, which claims priority under 35 U.S.C. §119(e) to European Patent Application No. 10006818.8 entitled "Pull Cord on Headrail For Operating a Motorized Blind" filed on Jul. 1, 2010, which applications are hereby incorporated by reference herein in their entireties.

FIELD

The invention relates to a motorized blind that is operated by a pull cord. The invention particularly relates to a blind with a pull cord which is mechanically connected to an electrical switch that is within the headrail of the blind and that is electrically connected to an electric motor within the headrail.

BACKGROUND

In known motorized blinds, manually-operated, electrical switches have been provided on the front of their headrails for allowing the owners of the blinds to turn on and off electric motors in the headrails to raise and lower window covering fabrics, slats or cells of the blinds. See U.S. Pat. No. 5,990,646. However, it has been rather inconvenient for owners of such motorized blinds to have to reach up to the switches on the headrails of such blinds each time that they wish to raise and lower the window coverings of the blinds.

SUMMARY

Accordingly, it is an object of this invention to provide a more convenient way for an owner of such a motorized blind to raise and lower the window covering of the blind by providing the blind with a pull cord which is mechanically connected to an electrical switch in a headrail of the blind; the switch being electrically connected to an electric motor within the headrail; and the pull cord also extending outwardly of an end of the headrail and then outwardly of the front of the blind.

Advantageously, the pull cord extends outwardly of the end of the headrail through a first hole in the end of the headrail.

Also advantageously, the pull cord extends outwardly of the front of the blind. through a second hole in the front of a removable end cap on the end of the head rail. In this regard, it is especially advantageous that the pull cord then extends downwardly from the second hole and that a bottom portion of the pull cord is attached to a cord weight beneath the end cap.

Further advantageously, a top portion of the pull cord is attached to the interior of the end of the headrail and extends, from there, through a third hole in a movable lever that is mechanically connected to the electrical switch within the headrail and, from there, through a first hole in the end of the headrail. It is particularly advantageous that the pull cord extends frontally from the first hole in the end of the headrail through the second hole in the front of the end cap. It is quite particularly advantageous that the pull cord extends downwardly from the second hole in the end cap and a bottom portion of the pull cord is attached to a cord weight beneath the end cap.

Further advantageous aspects of the invention will become clear from the following description of a preferred embodiment and from the claims. The invention will now be described with reference to the accompanying drawings, in which:

DETAILED DESCRIPTION

Figure 1:
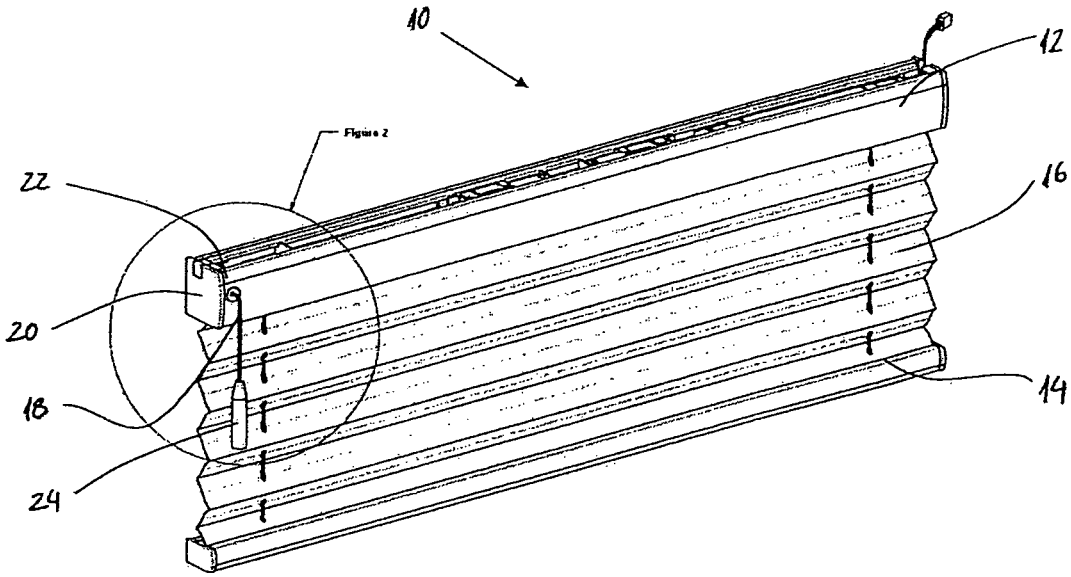
FIG. 1 is a perspective view of a blind with a pull cord extending downwardly from a hole in the front of an end cap on a left end of a headrail of the blind.
Figure 2:
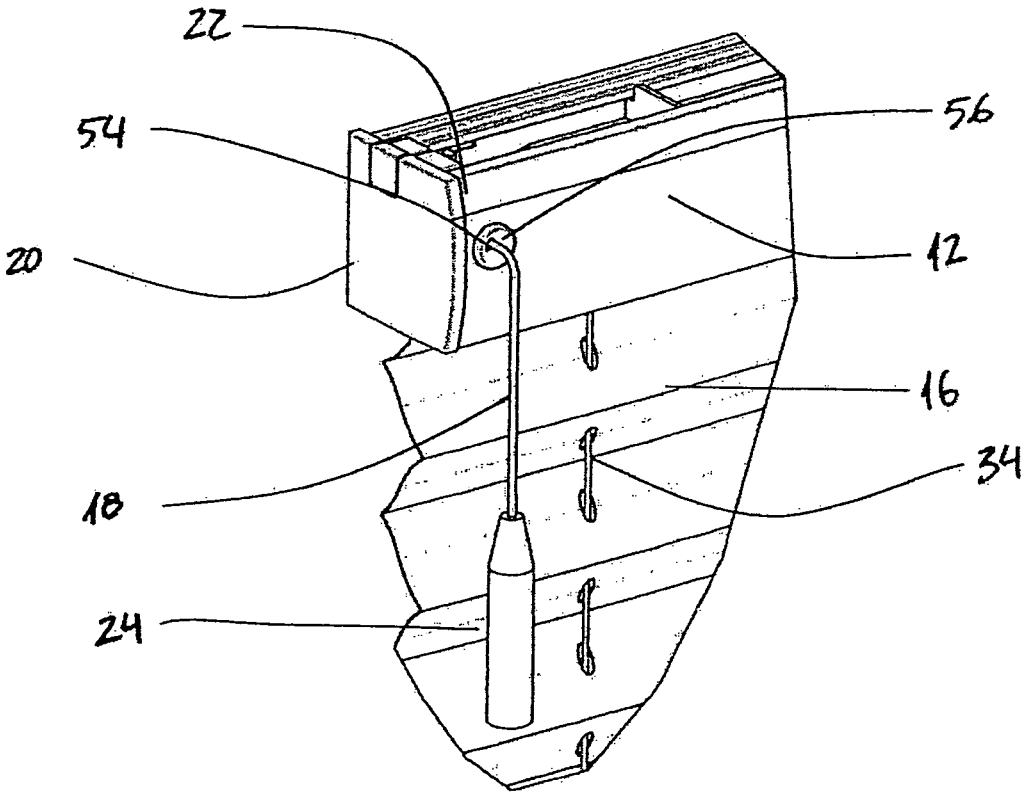
FIG. 2 is a detailed view of the pull cord extending downwardly from the hole in the end cap of the blind in FIG. 1.

FIGS. 1 and 2 show a motorized blind 10 with a headrail 12, bottom rail 14 and a pleated fabric shade material 16 as a window covering between the rails 12,14. A pull cord 18 extends outwardly of the front of the blind 10 through a removable end cap 20 on the left end 22 of the headrail 12. From there, the pull cord 18 extends downwardly of the blind to a conventional cord weight 24 on the bottom of the pull cord 18, beneath the left end cap 20.

Figure 3:
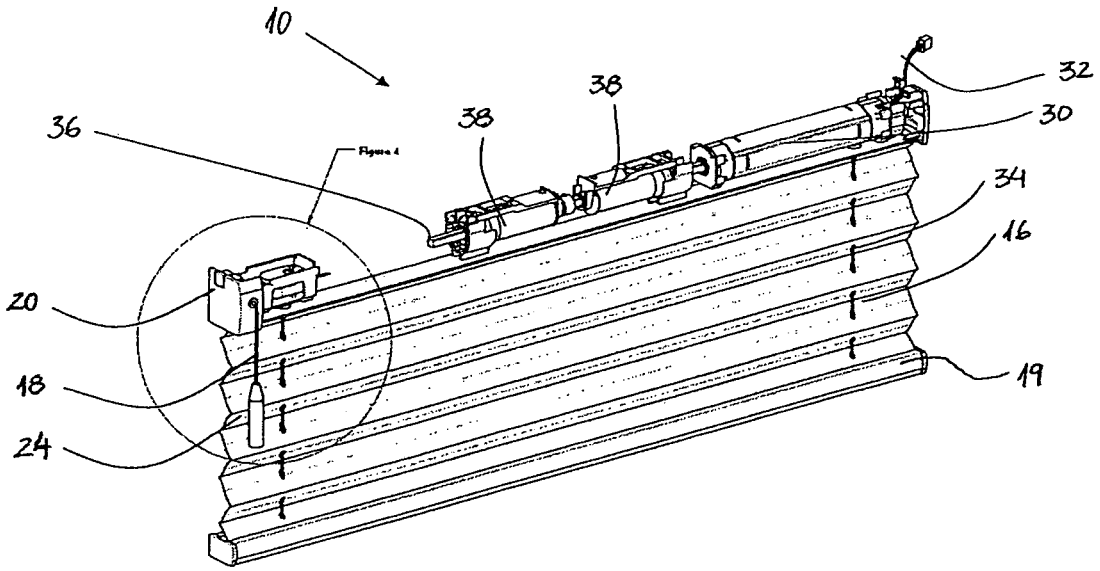
FIG. 3 is a perspective view of the blind of FIG. 1 with its headrail removed.
Figure 4:
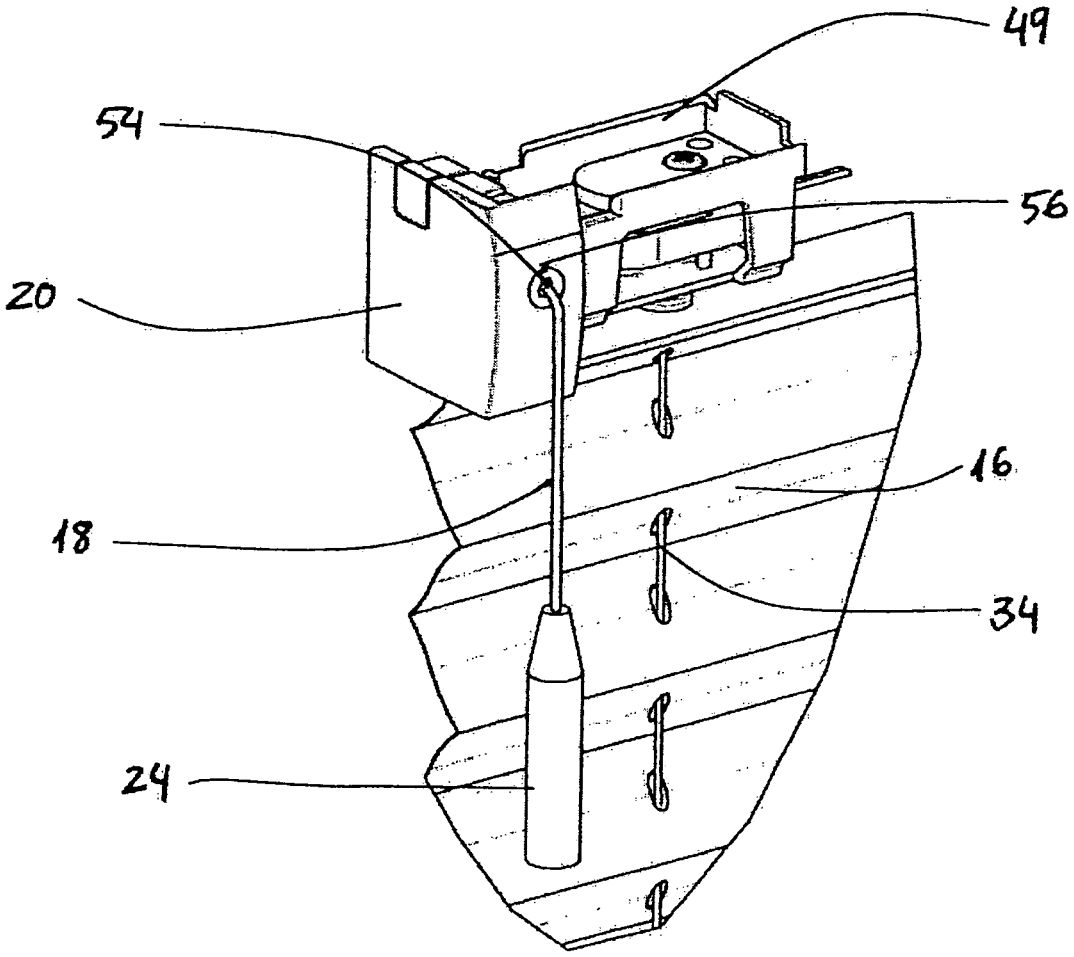
FIG. 4 is a detailed view of the pull cord extending downwardly from the hole in the end cap of the blind as shown in FIG. 3.

FIGS. 3 and 4 show the motorized interior of the headrail 12 of the blind 10. In this regard, the headrail contains an electric motor 30 with electrical connection cables 32, extending out of the headrail toward a conventional source of electric power (not shown). The motor is adapted to wind and unwind lift cords 34, the bottom of each of which is attached to the bottom rail 14. to raise and lower the fabric shade material 16. In this regard, the motor 30 is mechanically connected, by means of a conventional longitudinally-extending shaft 36, to conventional winding spools 38, each of which is attached to the top of one of the lift cords 34. As best seen in FIG. 3, the shaft 36 extends longitudinally through the headrail 12 (not shown) and through. the winding spools 38. Rotation of the motor 30 in one direction can wind the lift cords 34 about the winding spools 38, and rotation of the motor in an opposite direction can un wind the lift cords 34 from about the winding spools 38. A limit switch (not shown) is preferably provided in the motor 30 to prevent it from over-rotating in either direction.

FIGS. 3-9 show the interior of the headrail 12 and the hardware components therein. As best seen in FIGS. 5-9, a top portion 40 of the pull cord 18 is attached to the interior of the left end 22 of the headrail 12 and extends, from there, rightwardly and frontwardly to a free end 44 of a movable lever 46. The lever 46 is mechanically connected to an electrical switch 48 within the headrail. The lever 46 and switch 48 are mounted in a holder 49 attached to the top of the left end of the blind 10 within the headrail 12. The pull cord 18 is mechanically and slidingly connected to the free end 44 of the lever 46 which extends from the switch 48 towards the left end 22 of the headrail. The switch 48 is electrically connected to the electric motor 30 within the headrail. From the free end 46 of the movable lever 46, the pull cord 18 extends leftwardly and rearwardly out of the left end 22 of the head rail 12, and from there, the pull cord 18 extends frontwardly through the front of the left end cap 20 and then downwardly to the cord weight 24 on the bottom of the pull cord 18, beneath the left end cap 20, as shown in FIGS. 1-4.

The motor 30 can be any conventional DC motor for the headrail of retractable window coverings. The motor (30) is preferably a DC motor as described, for example, in U.S. Pat. No. 5,990,646 and WO2010/011751.

Likewise, the switch 48 can be any conventional mechanical switch for providing an electric signal to the motor 30 to change its direction of rotation as described, for example, in U.S. Pat. Nos. 7,399,940 and 7,652,439.

As best seen in FIGS. 5-9, a first rounded, longitudinally-extending hole 50 is provided in the left end 22 of the headrail 12 and the holder 49 therein to facilitate the passage of the pull cord 18 outwardly of the headrail and actuator. A first friction-reducing grommet 52 is preferably provided in the first hole 50.

As best seen in FIGS. 1-4, a second rounded, laterally-extending hole 54 is provided in the front of the removable left end cap 20 on the headrail 12 to facilitate the passage of the pull cord 18 outwardly of the left end cap. A second friction-reducing grommet 56 is preferably provided in the second hole 54.

Figure 5:
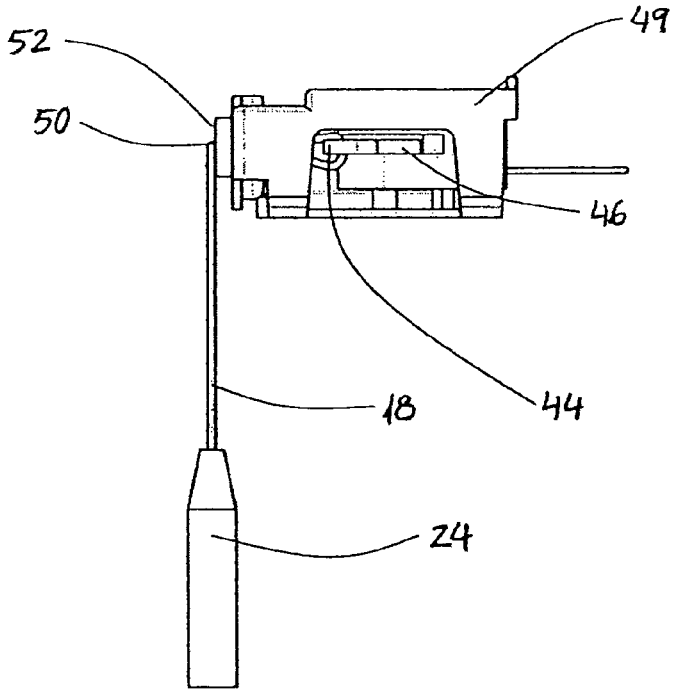
FIG. 5 is a front view of the interior of the left end of the headrail of the blind as shown in FIG. 3 with the end cap removed.
Figure 7:
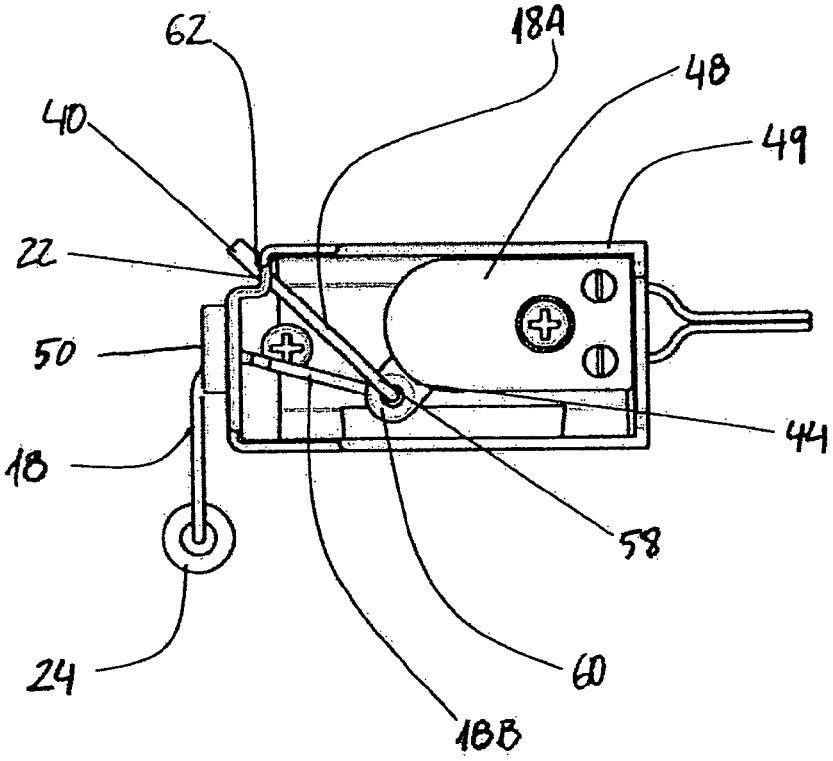
FIG. 7 is a top view of the interior of the left end of the headrail of the blind as shown in FIG. 5.

As best seen in FIGS. 5 and 7, a third rounded vertically-extending hole 58 is provided in the free end 44 of the movable lever 46 to facilitate the sliding and mechanical connection of the pull cord 18 with the lever's free end 44. A third friction-reducing grommet 60 is preferably provided in the third hole 58.

Preferably, as shown in FIG. 7, the pull cord 18 forms approximately a right angle at the first hole 50. As also shown in FIG. 7, the two strands 18A and 18B of the pull cord 18, connected to the lever's free end 44, preferably form an acute angle at the third hole 58, particularly an angle of about 25-45 degrees. Thereby, the two pull cord strands 18A, 18B form a pulley arrangement to make it easier to move the lever 46 by pulling on the bottom portions of the pull cord.

Figure 6:
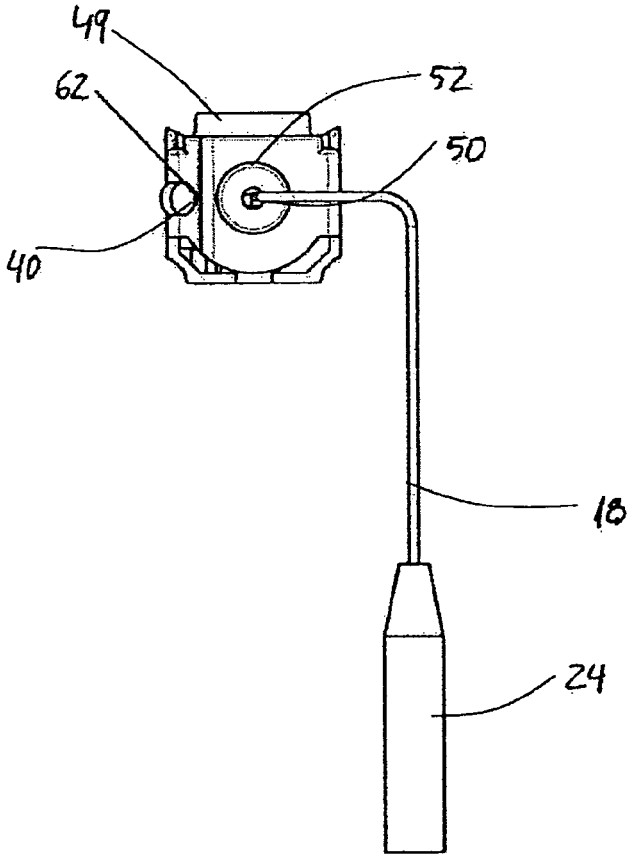
FIG. 6 is a left side view of the interior of the left end of the headrail of the blind as shown in FIG. 5.
Figure 8:
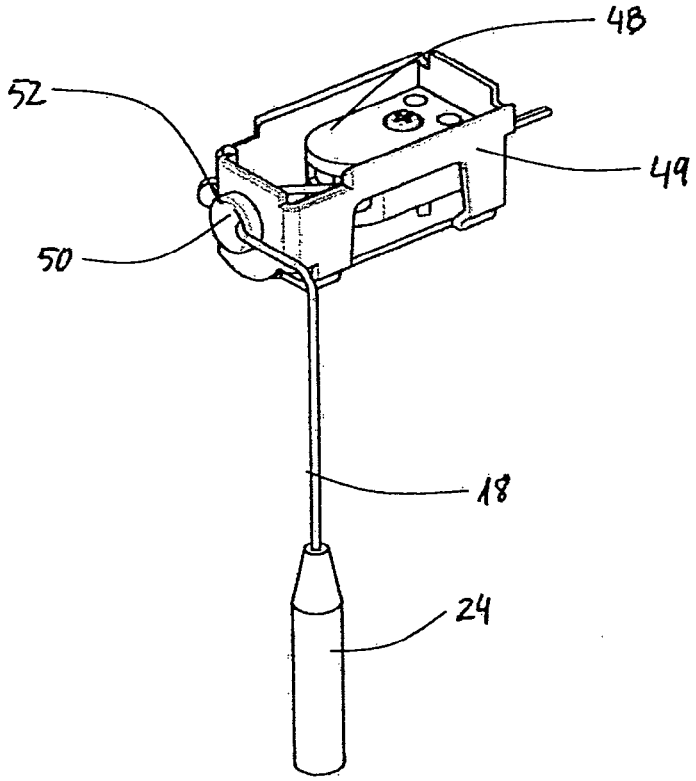
FIG. 8 is a perspective view of the interior of the left end of the headrail of the blind as shown in FIG. 5.
Figure 9:
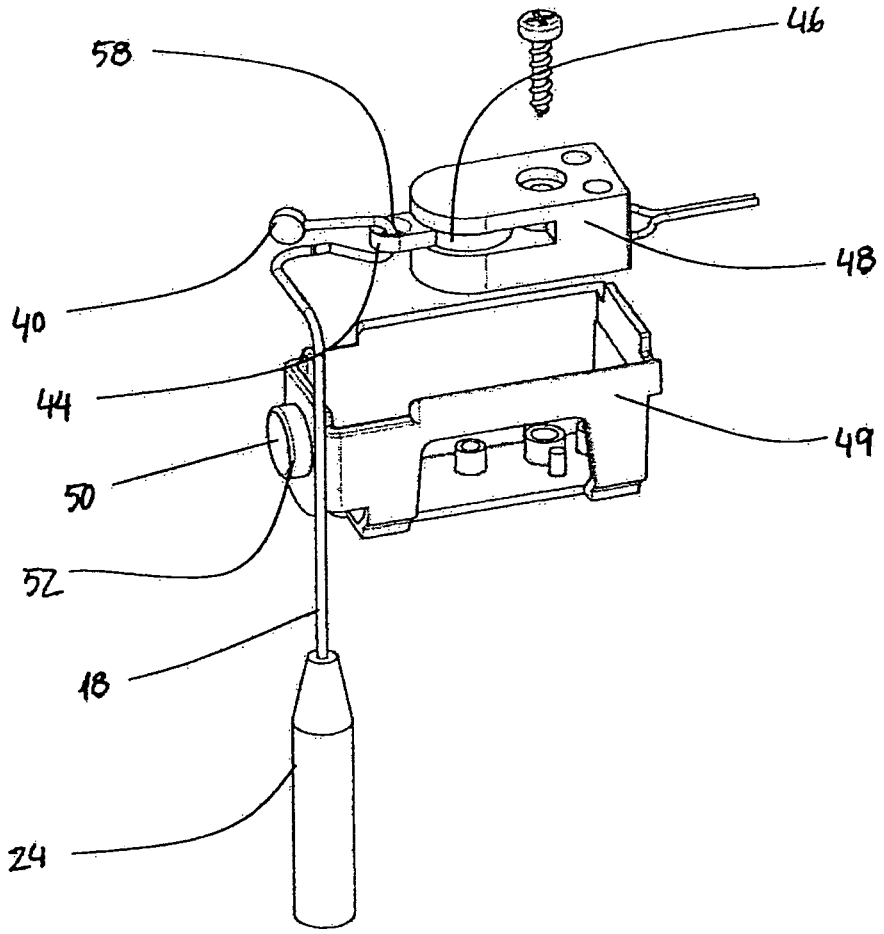
FIG. 9 is an exploded view of the interior of the left end of the headrail of the blind as shown in FIG. 5.

As best seen in FIGS. 6-8, a fourth laterally-extending hole 62 is preferably provided in the left rear end 44 of the holder 49, and the top portion 40 of the pull cord 18 extends outwardly of the holder 49 through the fourth hole 62. The top end of the pull cord 18, outside the holder 49, is preferably knotted to hold the pull cord on the blind 10.

The pull cord 18 can be made of any conventional high-strength polymer material such as nylon or polyester.

It is believed that the operation and construction of the invention will be apparent from the foregoing description. To one skilled in this art, it will be clear that the invention is not limited to the embodiment described herein. Also kinematic inversions are considered inherently disclosed and to be within the scope of the invention. Further, expressions such as: "top", "bottom", "interior", "downwardly", "front", "rear", "laterally" and "longitudinal" should be construed as relative terms which include equivalents for the structures disclosed. For example, the removable left end cap 20 with its second hole 54 and the outwardly-extending portions of the pull cord 18 and the holder 49 with the switch 48 and lever 46 could all be on the right end, rather than the left end, of the headrail 12 of the blind 10.

The invention claimed is:

1. A motorized blind having a pull cord; said pull cord being mechanically connected to an electrical switch in a headrail of said blind; said switch being electrically connected to an electric motor within said headrail; said pull cord extending outwardly of an end of said headrail.

2. The blind of claim 1 wherein said pull cord extends outwardly of said end of said headrail through a first hole in said end.

3. The blind of claim 2 wherein said pull cord extends downwardly of a front of said blind and a bottom portion of said pull cord is attached to a cord weight.

4. The blind of claim 2 wherein said pull cord extends outwardly of a front of said blind through a second hole in a front of a removable end cap on said end of said headrail.

5. The blind of claim 4 wherein said pull cord extends downwardly from said second hole and a bottom portion of said pull cord is attached to a cord weight positioned beneath said end cap.

6. The blind of claim 4 wherein a top portion of said pull cord is attached to an interior of said end of said headrail and extends, from there, to a free end of a movable lever that is mechanically connected to said electrical switch within said headrail and extends, from there, through said first hole in said end of said headrail; said pull cord being slidingly and mechanically connected to said free end of said lever.

7. The blind of claim 6 wherein said pull cord is slidingly and mechanically connected to a third hole in said free end of said lever.

8. The blind of claim 7 wherein said pull cord extends frontally from said first hole in said end of said headrail through said second hole in the front of said end cap.

9. The blind of claim 7 wherein a friction-reducing grommet is provided in one or more of said first, second and third holes.

10. The blind of claim 1, wherein said pull cord extends outwardly of a front of said blind.

11. The blind of claim 1, wherein:

said headrail includes an end, and an end cap enclosing said end of said headrail; and said switch is mounted to said end cap.

12. The blind of claim 11, wherein said switch is mounted in a holder positioned at least partially within said headrail and adjacent said end cap.

13. The blind of claim 12, wherein said pull cord extends outwardly from said end cap.

14. The blind of claim 11, wherein said pull cord extends outwardly from said end cap.

15. The blind of claim 14, wherein said pull cord extends outwardly from a front of said end cap.

16. The blind of claim 14, wherein said pull cord extends outwardly from an end of said end cap.

* * * * *